United States Patent [19]

Tanikawa et al.

[11] Patent Number: 4,580,321

[45] Date of Patent: Apr. 8, 1986

[54] FLUID-TIGHT SLIDE FASTENER

[75] Inventors: Koichi Tanikawa, Toyama; Toshiaki Takizawa, Kurobe, both of Japan

[73] Assignee: Yoshida Kogyo K. K., Tokyo, Japan

[21] Appl. No.: 741,143

[22] Filed: Jun. 4, 1985

[30] Foreign Application Priority Data

Jun. 13, 1984 [JP] Japan ..... 59-87882[U]

[51] Int. Cl.[4] ..... A44B 19/32

[52] U.S. Cl. ..... 24/389; 24/384; 24/393; 24/396

[58] Field of Search ..... 24/389, 384, 392, 393, 24/394, 396, 398, 433, 434

[56] References Cited

U.S. PATENT DOCUMENTS

| | | | |
|---|---|---|---|
| 3,501,816 | 3/1970 | Heimberger | 24/389 |
| 3,849,842 | 11/1974 | Yoshida | 24/393 |
| 3,874,036 | 4/1975 | Yoshikawa | 24/392 |
| 3,922,760 | 12/1975 | Matsuda | 24/393 |
| 3,952,380 | 4/1976 | Takamatsu | 24/393 |
| 3,974,550 | 8/1976 | Fujisaki et al. | 24/393 |
| 4,041,577 | 8/1977 | Matsuda | 24/393 |

FOREIGN PATENT DOCUMENTS 55-31939 9/1980 Japan .

*Primary Examiner*—Victor N. Sakran

*Attorney, Agent, or Firm*—Hill, Van Santen, Steadman & Simpson

[57] ABSTRACT

A fluid-tight slide fastener comprises a pair of slide fastener halves each including a support tape, a row of continuous coupling elements extending longitudinally along the inner edge of the tape on one side thereof, and an elastomeric sealing member overlying the other side of the tape. The tape has a longitudinal ridge substantially defining the inner edge and supporting the row of coupling elements laterally longitudinally by means of stitching threads. A portion of the threads is disposed adjacent to the ridge to prevent the latter from moving remotely from the coupling elements row for thereby supporting the ridge intimately enough to ensure the abuttment of opposed sealing edges of the tapes when the fastener halves are coupled together.

4 Claims, 10 Drawing Figures

PRIOR ART

FLUID-TIGHT SLIDE FASTENER

BACKGROUND OF THE INVENTION

1. Field of the Invention

The present invention relates to a slide fastener, and more particularly to a fluid-tight slide fastener stringer.

2. Prior Art

There are known various fluid-tight slide fasteners. One such fluid-tight slide fastener includes a stringer tape which supports edgewisely a row of continuous coupling elements on one side and a sealing member on the other side. For example a fluid-tight slide fastener of this type is disclosed by U.S. Pat. No. 3,501,816 as shown in FIG. 9 of the accompanying drawings. This slide fastener produces a seal when a pair of rows of coupling elements 102 are coupled underneath the coplanar stringer tapes 101 urging opposed sealing lips 104 to bear against each other above the tapes 101. Each of the sealing lips 104 formed into a wedge-shaped projection is raised from a general plane of the coplanar tapes 101 with the result that the sealing lips 104 neccessarily bear upon each other with a sealing force directed at a level remote from a level at which the coupling elements 102 are intermeshed together. In this mutually compressed relation, only the tapes 101 support the opposing sealing lips 104. The supporting tapes 101, however, fail to support the same strongly enough to keep the sealing force unidirectional and parallel to the general plane of the tapes to obtain most effective seal against leakage.

Another type of fluid-tight slide fastener is disclosed by Japanese Utility Model Publication (Jikkosho) No. 55-31939. This prior fastener as shown in FIG. 10 includes a pair of stringer tapes 201, each having a row of discrete coupling elements 203 each bracketing a longitudinally folded edge 202 of the tape 201 and a sealing member 204 underlying the latter for thereby allowing the sealing members 204 to be sandwiched tightly in between the elements rows and the folded tape edges. However, each one of the discrete coupling elements 203 has a bracketing structure 203*a* which adds to the cost of manufacture of the slide fastener products and also impairs the appearance of an article to which the fastener is attached.

SUMMARY OF THE INVENTION

According to the principles of the present invention, a fluid-tight slide fastener comprises a pair of slide fastener halves or stringers to be joined with each other along their respective longitudinal edges. Each stringer includes a support tape, a row of continuous coupling elements extending longitudinally on one side of the tape, and an elastomeric sealing member overlying the other side of the tape. The support tape has a ridge extending longitudinally for substantially defining an innermost edge of the tape. The sealing member transversely extends over the edge-defining ridge and projects beyond a vertical median plane of symmetry between the interengaged stringers for thereby forming a longitudinal contact edge portion, the latter being supported by the ridge. The row of continuous coupling elements is secured to the tape by a connecting means such as threads, a portion of which is disposed close to the ridge for enabling the latter to fixedly support the coupling elements rows, with the result that the threads prevent the ridges from being displaced remotely from the coupling elements row.

It is therefore an object of the invention to provide a slide fastener producing an effective fluid-tight seal even when the same has a relatively simple structure including a known continuous coupling elements stitched thereto by a conventional stitching means.

Many other advantages, features and additional objects of the present invention will become manifest to those versed in the art upon making reference to the detailed description and the accompanying drawings in which preferred embodiments incorporating the principles of the present invention are shown by way of illustrative examples.

DETAILED DESCRIPTION

The principles of the present invention are particularly useful when embodied in a fluid-tight slide fastener such as embodiments shown in the accompanying drawings.

Figure 1:
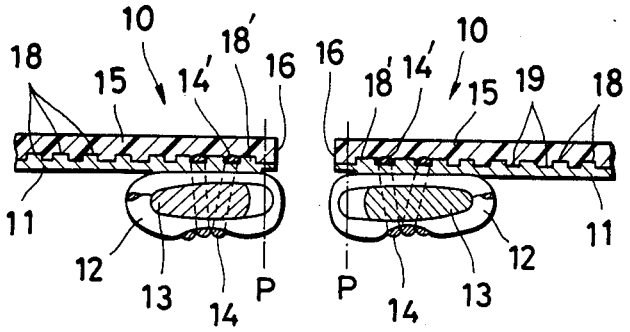
FIG. 1 is a schematic transverse cross-sectional view of a fluid-tight slide fastener halves according to the invention, showing the same being separated from each other.

In FIG. 1, a pair of slide fastener halves or stringers 10, 10 are substantially mirror images of each other and lying in a general plane. To clarify the description of the invention, only one of the stringers is described hereinafter.

The fastener stringer 10 includes a stringer tape or support tape 11 supporting on one side thereof a row of continuous coupling elements 12 extending along its innermost longitudinal edge and an elastomeric sealing member 15 lying substantially coextensively on the other side thereof.

The support tape 11 is made of a warp-knitted fabric having alternating ridges (or wales) 18 and grooves 19 extending longitudinally in a parallel relation to one another on one side of the tape 11. The warp-knitted fabric is diagrammatically illustrated in FIG. 5. An innermost one of the ridges 18' substantially defines the innermost edge of the tape 11.

The row of continuous coupling elements 12 formed into a continuous helical coil includes a core 13 extending therethrough, and is stitched securely to the support tape 11 by means of threads 14 running via the core 13 in and out of the tape 11. The threads 14 have a portion 14' disposed adjacent to the innermost ridge 18', namely in a groove 19 defined between the ridge 18' and another ridge 18 adjacent to the latter, so that the threads 14 hold the ridge 18' in place with respect to the row of the coupling elements 12, and enable the ridge 18' to support obliquely the coupling elements row 12.

The sealing member 15 is made, of an elastically deformable material such as silicone rubber, butyl, neoprene, polyurethane rubber or other elastomeric material.

Figure 2:
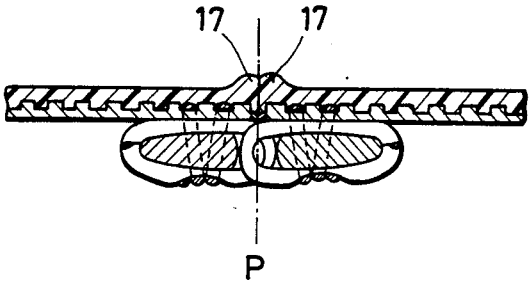
FIG. 2 is a schematic transverse cross-sectional view similar to FIG. 1, showing the same being coupled.

The sealing member 15 is secured substantially coextensively to the tape 11 and extends over the ridge 18' for providing a longitudinal contact edge portion 16 projecting transversely beyond a vertical median plane of symmetry P of the interengaged stringers 10. The contact edge portion 16 is thus reinforced by the ridge 18' supporting on its innermost side the same. The contact edge portions 16 of the stringers 10 are adapted to abut on each other to produce a tight seal therebetween when the stringers are coupled together as shown in FIG. 2. Each one of the contact edge portions 16 is transversely reinforced by the ridge 18' of the tape.

Figure 5:
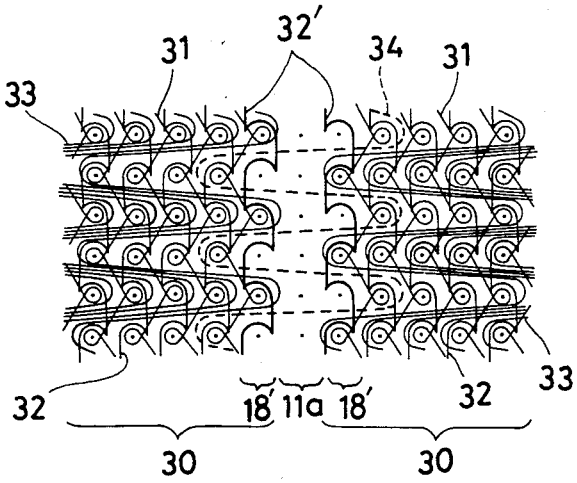
FIG. 5 is a point diagram illustrating a warp-knitted fabric structure of the support tape of FIGS. 1 and 2.

FIG. 5 diagrammatically shows a warp-knitted fabric of which the support tapes 11 is made. The warp-knitted fabric comprises a pair of base portions or webs 30 and a connector portion 11*a* extending longitudinally therebetween. Each one of the base portions 30 includes a plurality of threads 31 knitted as tricot stitches, a plurality of threads 32 knitted as chain stitches, and a plurality of weft threads 33 running transversely of the threads 31, 32 across the tape. The threads 31, 32 run longitudinally to form in combination a plurality of wales 18 each including a succession of stitch loops of the threads 31, 32. Each one of the weft theads 33 runs over respective five wales 18 in alternately reversed directions and looping in either one of the most remote pair in five wales 18. The innermost adjacent pair of wales 18' respectively includes threads 32' each having a higher degree of strength than the other threads 31, 32, 33 so as to solidify the wales 18' defining the ridges of the tapes 11. The connector portion 11*a* includes a connector thread 34 extending longitudinally in a zigzag fashion via the innermost wales 18' of the base portions 30 for interconnecting the same to each other. The connector portion 11*a* is free from wales, and thus thinner than the base portions 30. The base portions 30 in FIG. 5 correspond to a pair of the support tapes 11 in FIG. 1, respectively. With this warp-knitted fabric structure of a high stitch-density, the wales 18' per se are strong enough to suppress an anti-pressing force to due resiliency in the sealing material at the contact edge portions 16.

When the stringers 10 are coupled together as shown in FIG. 2 by interengaging both rows of coupling elements 12, the opposed longitudinal edges or ridges 18' of the tapes 11 are forced to move toward each other, whereupon the ridges 18' and the contact edge portions 16 supported thereon are hindered from moving remotely from the coupling elements rows 12, in other words upwardly as viewed in FIG. 2. As a result, the edge-defining ridges 18' of the tapes supportably push the respective contact edge portions 16 in an abuttment relation parallel to the general plane of the tapes 11 and hence of the stringers 10 for thereby bearing against each other to produce a fluid-tight seal in the median plane P. At this time masses of longitudinal edge portions 16 bulge sideways to form raised portions 17 ensuring the tight seal between the sealing members 15 in the median plane P.

Figure 3:
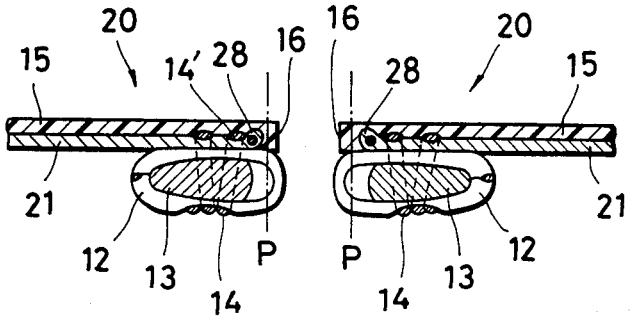
FIG. 3 is a schematic transverse cross-sectional view of another embodiment of the invention, showing the same being separated.
Figure 4:
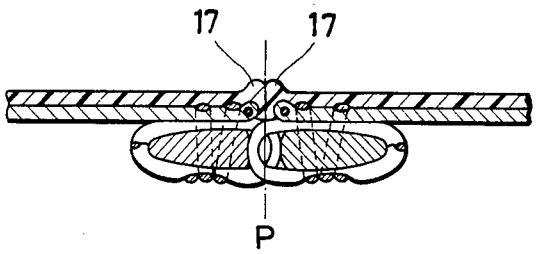
FIG. 4 is a schematic transverse cross-sectional view similar to FIG. 3, showing the same being coupled.

FIG. 3 shows another embodiment similar to the stringers of FIGS. 1 and 2, and one difference therefrom is the structure of the support tapes 21. The tape 21 is made of a woven fabric comprising a plurality of warp threads and a plurality of weft threads (not shown), and has a longitudinal ridge 28 having a function similar to the ridge 18' of the stringer 10 of FIG. 1. The ridge 28 is defined by one of the warp threads 28 extending longitudinally through the weft threads of the tape 21. The warp threads 28 have a thickness greater than that of the other warp threads. Alternatively, the ridge may be formed into a cord extending similarly through the weft threads. The row of coupling elements 12 is secured similarly to the tape 21 by means of the threads 14, a portion of which is located adjacent to the ridge 28 so that the threads 14 hold the ridge 28 in place and prevent the same from being displaced remotely from the coupling elements row 12 when the stringers 20 are coupled together. Thus the tapes 20 also provide the ridges 28 supporting the opposed contact edge portions 16 through the threads 14 stably enough to force the latter to bear upon each other as shown in FIG. 4. Therefore the stringers 20 also produce a stable fluid-tight seal when coupled together.

Figure 6:
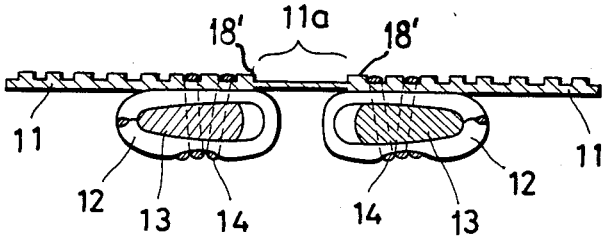
FIGS. 6 through 8 are schematic transverse cross-sectional views of the fluid-tight slide fastener of FIGS. 1 and 2, illustrating manufacturing processes of the same.
Figure 7:
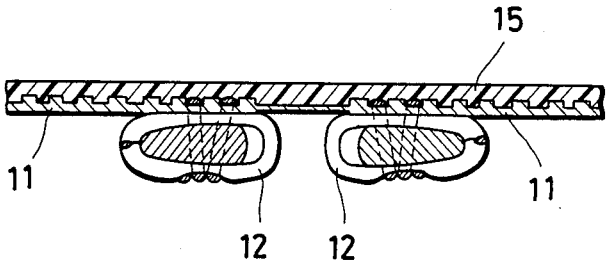
Figure 8:
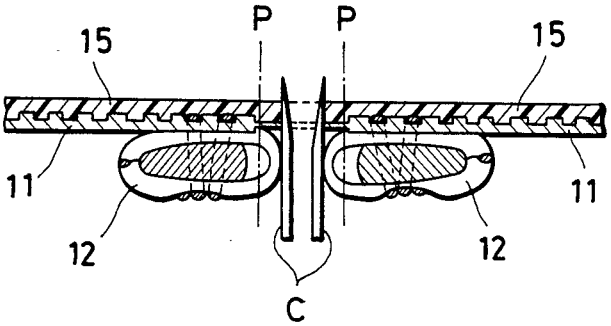
Figure 9:
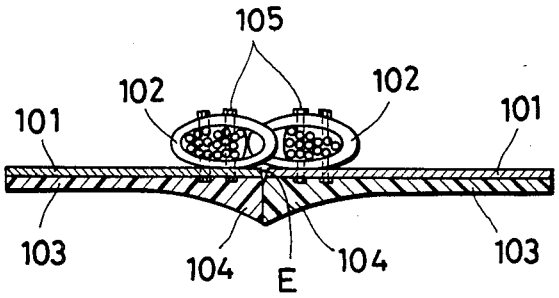
FIGS. 9 and 10 are schematic transverse cross-sectional view of prior fluid-tight slide fasteners.

FIGS. 6 through 8 illustrate a manufacturing process of the fluid-tight slide fastener according to the invention.

In FIG. 6, a pair of coplanar support tapes 11 having the opposed longitudinal ridges respectively on one side thereof are laterally continuous to each other via the connector portion 11*a*. The pair of continuous coupling elements 12 are stitched to the other sides of the tapes respectively by means of the stitching threads 14 along the respective innermost edges of the tapes 11. The threads 14 are partially disposed adjacent to the respective ridges 18'.

Then as shown in FIG. 7, the sealing material 15 is attached to all the surface of the other side of the coplanar continuous tapes 11. The tapes 11 with the sealing member attached thereto are cut into a pair of fastener halves or stringers 10 by a cutter means C as shown in FIG. 8 with the result that each one of the separate stringers 10 provides the longitudinal contact edge portion 16 projecting beyond the vertical median plane P as shown in FIG. 8. At this time, fragments of the connector threads 34 remaining in the tapes 11 may be removed as in as the embodiment shown in FIG. 1.

In each one of the embodiments described above, the support tapes have the opposed longitudinal ridges disposed adjacent to the corresponding contact edge portions of the sealing material. With this arrangement, the slide fastener has the ridges of the tapes deliberately supporting the contact edge portion strongly enough to suppress a resilient force normally urging to recover the original form of the contact edge portion and thus pushing back the latter in the opposite direction, with the result that the same are kept to bear against each other for producing a fluid-tight seal therebetween.

Figure 10:
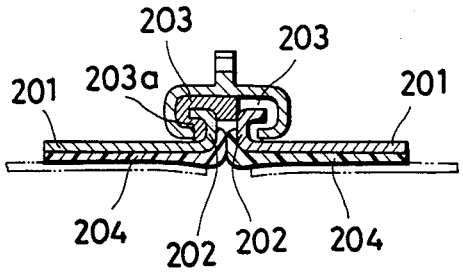
PRIOR ART FIG. 10

Advantageously, these embodiments may incorporate conventional continuous coupling elements to be stitched to the tape, for thereby eliminating a neccessity of relatively complicated structure such as the coupling elements 203 having bracket portions 203*a* of the prior fastener of FIG. 10. Therefore the slide fastener embodying the invention has a simple structure which enables for an economical production of effective fluid-tight slide fasteners.

Although various minor modifications may be suggested by those versed in the art, it should be understood that we wish to embody within the scope of the patent warranted hereon, all such embodiments as reasonably and properly come within the scope of our contribution to the art.

What is claimed is:

1. a fluid-tight slide fastener comprising a pair of fastener halves each including:

(a) a support tape;

(b) a row of continuous coupling elements extending along an innermost longitudinal edge of said tape on one side of the latter;

(c) a connecting means for securing said row of coupling elements to said tape;

(d) an elastomeric seal member extending on the other side of said tape in a substantially coextensive relation, and having a longitudinal contact edge portion transversely projecting beyond a median plane of symmetry defined by said slide fastener halves in engagement, said plane being perpendicular to a general plane of said seal member, said longitudinal contact edge portion being adapted to bear against an opposed longitudinal contact edge portion of the mating fastener half; and (e) said support tape including a longitudinal ridge substantially defining said longitudinal edge of said tape and projecting from said other side of said tape for supporting said contact edge portion on top and innermost sides of said ridge.

2. A fluid-tight slide fastener according to claim 1, said connecting means comprising threads having a portion thereof disposed adjacent to said longitudinal ridge and remotely from said longitudinal contact edge portion.

3. A fluid-tight slide fastener according to claim 1, is made of said tape is made of a knitted fabric including a plurality of wales on at least said other side thereof, an innermost one of said wales providing said longitudinal ridge portion.

4. A fluid-tight slide fastener according to claim 1, is made of said tape is made of a woven fabric including an innermost warp thread thicker than the other threads of said woven fabric, said innermost thread providing said longitudinal ridge portion.

* * * * *